US011037394B2

(12) United States Patent
Ascheri-Phillips et al.

(10) Patent No.: US 11,037,394 B2
(45) Date of Patent: Jun. 15, 2021

(54) TABLETOP/FURNITURE GAME SCREEN METHODS

(71) Applicant: IGT, Las Vegas, NV (US)

(72) Inventors: Samantha Ascheri-Phillips, Reno, NV (US); Patrick Danielson, Las Vegas, NV (US)

(73) Assignee: IGT, Las Vegas, NV (US)

( * ) Notice: Subject to any disclaimer, the term of this patent is extended or adjusted under 35 U.S.C. 154(b) by 0 days.

(21) Appl. No.: 16/589,974

(22) Filed: Oct. 1, 2019

(65) Prior Publication Data

US 2021/0097802 A1 Apr. 1, 2021

(51) Int. Cl.
*G07F 17/00* (2006.01)
*G07F 17/32* (2006.01)

(52) U.S. Cl.
CPC ..... *G07F 17/3211* (2013.01); *G07F 17/322* (2013.01)

(58) Field of Classification Search
None
See application file for complete search history.

(56) References Cited

U.S. PATENT DOCUMENTS 7,306,516 B2 * 12/2007 Iosilevsky ..... G07F 17/32 463/13
7,893,953 B2 * 2/2011 Krestakos ..... H04N 7/142 348/14.01
8,125,578 B2 * 2/2012 Choi ..... G09G 3/002 348/840
8,439,756 B2 * 5/2013 Baerlocher ..... G07F 17/3276 463/37
9,129,473 B2 * 9/2015 Nguyen ..... G07F 17/3211
9,524,606 B1 * 12/2016 Stasi ..... G07F 17/3255
10,008,070 B2 * 6/2018 Nordahl ..... G07F 17/322
10,702,763 B2 * 7/2020 Chun ..... G07F 17/32
2002/0077170 A1 * 6/2002 Johnson ..... G07F 17/3211 463/16
2002/0185981 A1 * 12/2002 Dietz ..... G06F 3/0446 315/169.3
2004/0070149 A1 * 4/2004 Lipscomb ..... A47B 25/00 273/309
2005/0049049 A1 * 3/2005 Griswold ..... G07F 17/3206 463/46
2005/0178074 A1 * 8/2005 Kerosetz ..... A47F 9/02 52/36.1

(Continued)

*Primary Examiner* — Paul A D'Agostino
(74) *Attorney, Agent, or Firm* — Sheridan Ross P.C.

(57) ABSTRACT

In certain embodiments, a furnishing can comprise a display device disposed on a surface of the furnishing and a sensor providing an electrical signal indicating a presence of a player within a predetermined distance and a location of the player relative to the display device. A processor can be coupled with the display device and the sensor. A memory can be coupled with and readable by the processor and can store therein a set of instructions which, when executed by the processor, causes the processor to receive the electrical signal from the sensor and detect the presence and the location of the player relative to the display device based on the electrical signal. The instructions can further cause the processor to present an instance of the electronic game on the display device dynamically adapted based on the detected presence and location of the player relative to the display device.

20 Claims, 9 Drawing Sheets

(56) References Cited

U.S. PATENT DOCUMENTS

2006/0040730 A1* 2/2006 Walker ..... G07F 17/32 463/20
2006/0068870 A1* 3/2006 Crawford, III ..... G07F 17/3293 463/13
2007/0072682 A1* 3/2007 Crawford, III ..... G07F 17/3276 463/46
2007/0120320 A1* 5/2007 Miltenberger ..... G07F 17/3213 273/143 R
2007/0157856 A1* 7/2007 Skoog ..... A47B 81/061 108/70
2007/0188444 A1* 8/2007 Vale ..... G06F 3/0421 345/156
2008/0076581 A1* 3/2008 Mattice ..... G06F 3/045 463/46
2008/0214287 A1* 9/2008 Lutnick ..... G07F 17/32 463/25
2008/0234047 A1* 9/2008 Nguyen ..... G07F 17/3234 463/42
2008/0236452 A1* 10/2008 Pratt ..... A47B 85/00 108/13
2009/0115133 A1* 5/2009 Kelly ..... A63F 13/52 273/274
2009/0124321 A1* 5/2009 Gadda ..... G07F 17/322 463/16
2009/0124362 A1* 5/2009 Cuddy ..... G07F 17/3244 463/27
2009/0191933 A1* 7/2009 French ..... A63F 1/10 463/12
2009/0325686 A1* 12/2009 Davis ..... G07F 17/322 463/25
2010/0087241 A1* 4/2010 Nguyen ..... G07F 17/3225 463/17
2011/0115158 A1* 5/2011 Gagner ..... G07F 17/3211 273/274
2011/0298751 A1* 12/2011 Merel ..... G06F 3/0425 345/175
2012/0062475 A1* 3/2012 Locker ..... G06F 3/041 345/173
2012/0080845 A1* 4/2012 Emori ..... G07F 17/3237 273/309
2013/0303274 A1* 11/2013 Gadher ..... G07F 17/3218 463/29
2014/0370980 A1* 12/2014 Czyzewski ..... G07F 17/322 463/31
2015/0012307 A1* 1/2015 Moss ..... G06Q 10/02 705/5
2015/0326453 A1* 11/2015 Bishop ..... H04L 43/04 709/224
2016/0184712 A1* 6/2016 Colenbrander ..... A63F 13/49 463/29
2017/0018137 A1* 1/2017 Kugler ..... G06F 3/041
2017/0330237 A1* 11/2017 Canceri ..... G06K 9/00295
2018/0089952 A1* 3/2018 Heenan ..... G07F 17/3276
2018/0095542 A1* 4/2018 Mallinson ..... G06F 1/163
2020/0029707 A1* 1/2020 Lukas ..... A47C 3/30

* cited by examiner

TABLETOP/FURNITURE GAME SCREEN METHODS

BACKGROUND

Embodiments of the present disclosure relate generally to electronic gaming machines and more particularly to an electronic gaming machine implemented in a furnishing such as piece of furniture.

Electronic Gaming Machines (EGM) found in casinos and other gaming venues provide electronic versions of games such as video poker, slots, roulette, blackjack, etc. Such EGMs are built into freestanding cabinets which are typically rather large. In other cases, EGMs may be mounted on a bar top. However, this type of installation reduces the usable space of the bar top. Currently, and as a result, gaming areas are limited in their design by these bulky gaming cabinets that are usually lined up in rows around a gaming floor. In addition to limited design options for gaming floor layout, these designs for EGMs also limit their use to casinos and similar venues. Other venues, such as restaurants, bars, nightclubs, etc. are reluctant to provide EGMs onsite due to their bulk. Hence, there is a need in the art for improved implementations of electronic gaming machines.

BRIEF SUMMARY

In certain embodiments, the present disclosure relates to a furnishing comprising a display device disposed on a player accessible surface of the furnishing and a sensor providing an electrical signal indicating a presence of a player within a predetermined distance of the display device and a location of the player relative to the display device. A processor can be coupled with the display device and the sensor. A memory can be coupled with and readable by the processor and can store therein a set of instructions which, when executed by the processor, causes the processor to receive the electrical signal from the sensor and detect the presence of the player within the predetermined distance of the display device and the location of the player relative to the display device based on the electrical signal. The instructions can further cause the processor to present an instance of the electronic game on the display device. An orientation of the instance of the electronic game as presented on the display device can be dynamically adapted based on the detected presence of the player within the predetermined distance of the display device and the location of the player relative to the display device.

According to another embodiment, an electronic gaming machine can comprise a furnishing having a player accessible surface. A first display device can be disposed on the player accessible surface and can form a first portion of the player accessible surface. A first sensor can be disposed at a first location on the furnishing and can provide an electrical signal indicating a presence of a first player within a predetermined distance of the first display device and a location of the first player relative to the first display. A second display device can be disposed on the player accessible surface and can form a second portion of the player accessible surface. A second sensor can be disposed at a second location and can provide an electrical signal indicating a presence of a second player within a predetermined distance of the second display device and a location of the second player relative to the second display device. A processor can be coupled with each of the first display device, the second display device, the first sensor, and the second sensor. A memory coupled with and readable by the processor and can store therein a set of instructions which, when executed by the processor, causes the processor to receive the electrical signal from the first sensor and detect the presence of the first player within the predetermined distance of the first display device and the location of the first player relative to the first display device based on the electrical signal from the first sensor. The instructions can further cause the processor to present a first instance of the electronic game on the first display device, wherein an orientation of the first instance of the electronic game as presented on the first display device is dynamically adapted based on the detected presence of the first player within the predetermined distance of the first display device and the location of the first player relative to the first display device. The instructions can further cause the processor to receive the electrical signal from the second sensor and detect the presence of the second player within the predetermined distance of the second display device and the location of the second player relative to the second display device based on the electrical signal from the second sensor. The instructions can further cause the processor to present a second instance of the electronic game on the second display device, wherein an orientation of the second instance of the electronic game as presented on the second display device is dynamically adapted based on the presence of the second player within the predetermined distance of the second display device and the location of the second player relative to the second display device. The instructions can further cause the processor to coordinate the first instance of the electronic game with the second instance of the electronic game.

According to yet another embodiment, a method for providing an electronic game through a display device disposed within and forming a surface of a furnishing can comprise receiving, by a processor of the furnishing, an electrical signal from a sensor of a plurality of sensors. Each sensor of the plurality of sensors can be disposed at a different location on the furnishing. The electrical signal can indicate a presence of a player within a predetermined distance of the display device and a location of the player relative to the display device. The presence of the player within the predetermined distance of the display device and the location of the player relative to the display device can be detected by the processor of the furnishing based on the received electrical signal. An instance of the electronic game can be presented by the processor of the furnishing on the display device. An orientation of the instance of the electronic game as presented on the display device can be dynamically adapted based on the detected presence of the player within the predetermined distance of the display device and the location of the player relative to the display device.

Additional features and advantages are described herein and will be apparent from the following Description and the figures.

DETAILED DESCRIPTION

Embodiments of the present disclosure will be described in connection with an electronic gaming machine implemented in a furnishing such as piece of furniture. Generally speaking, an electronic gaming machine can comprise any type of electronic device providing an electronic version of a game of chance including, but not limited to, video poker, video roulette, video black jack, video craps, video slots, video bingo, video pachinko, etc. A furnishing can be considered any type of furniture, fittings, or other decorative accessories, such as pictures, digital displays, etc. Typical electronic gaming machines are unwieldy to move once they are installed in a particular location because of their size. Even if the machine can be downsized to a moveable size, it usually provides a view of the game from only a single perspective, usually to a player standing or sitting in front of the machine.

According to one embodiment, lightweight display devices such as Organic Light Emitting Diode (OLED), Liquid Crystal Display (LCD), E-Ink, etc. can be used to integrate electronic games in to a variety of different furnishings such as screens or windows that can be mounted on walls or tables and other furniture to allow gameplay in spaces that would not normally support gaming such as restaurants, lounges, cafes, or poolside. Sensors, such as motion, proximity, weight, heat, heartrate detectors, etc. can be embedded into the side of the table or other furnishing and can be used to detect the presence and location of one or more people around the furnishing. Based on this information, the display of the electronic game on the display device can be dynamically adapted. For example, when a potential player sits down or stands near the table or other furnishing, the display can be reoriented and/or resized based on where the player is sitting or standing.

Figure 1A:
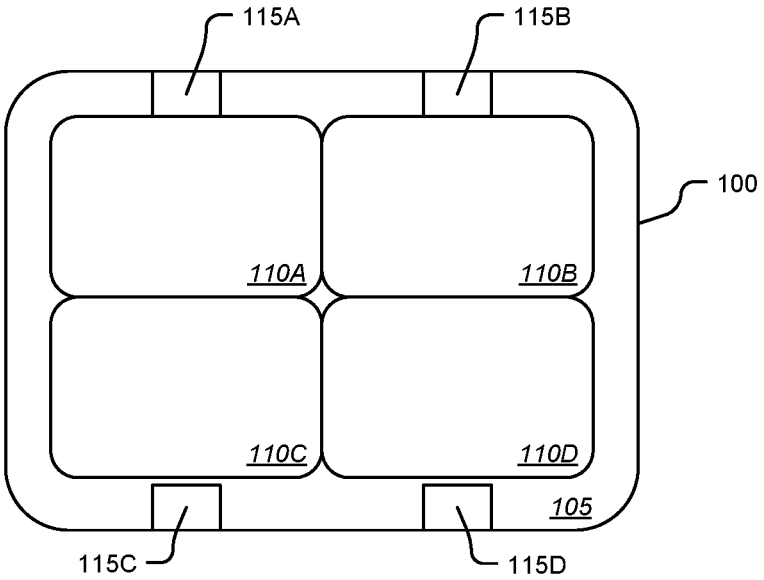
FIGS. 1A and 1B are illustrations of various views of an exemplary furnishing according to one embodiment of the present disclosure.
Figure 1B:
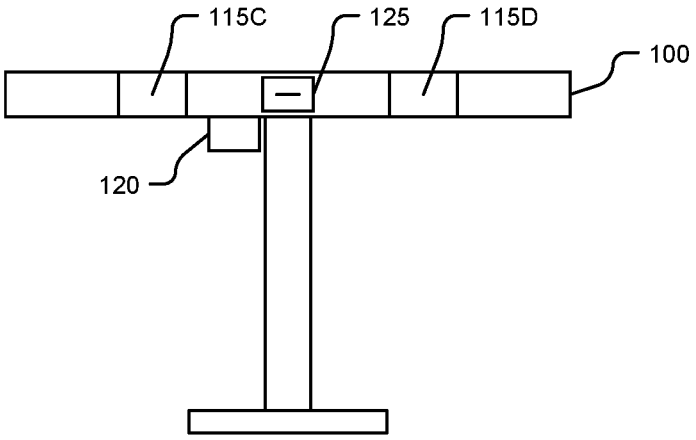

FIGS. 1A and 1B are illustrations of various views of an exemplary furnishing according to one embodiment of the present disclosure. More specifically, FIG. 1A illustrates a top view of a furnishing 100, specifically a table, in which an electronic gaming machine can be implemented while FIG. 1B illustrates a side view of the same table. As illustrated in this example, a furnishing 100 can comprise one or more display devices 110A-110D disposed on a player accessible surface 105 of the furnishing 100, in this case, the top surface. The one or more display devices 110A-110D can be mounted on the player accessible surface 105 of the table and can appear to be the glass on the table top. When multiple display devices are used, as illustrated here, brackets can physically connect the screens or the display devices 110A-110D can interconnect through plug-in type connectors. However, in other implementations, a single display device may be used which can be logically divided into different portions equivalent to the display devices 110A-110D as illustrated here and which can be controlled separately as if they where different physical devices and as will be described herein.

One or more sensors 115A-115D can be disposed in the furnishing 100 at different locations. For example, the sensors 115A-115D can be mounted on or embedded in an edge of the table top as illustrated here. The sensors 115A-115D can be positioned so that a detection zone or the sensor can cover a position at which a player or spectator would sit or stand if playing or watching a game on one or the display devices 110A-110D. Each sensor 115A-115D can provide an electrical signal indicating a presence of a player within a predetermined distance of the display device and a location of the player relative to the display device 110A-110D. The sensors 115A-115D can comprise any one or more types of sensors using a variety of technologies known in the art. For example, the sensors 115A-115D can comprise proximity sensors based on ultrasonic, capacitive, photoelectric, inductive, or magnetic detection. Additionally, or alternatively, sensors 115A-115D can comprise motion detectors based on infrared light, ultrasound, or microwave/radar detection technology. Image sensors, e.g., digital cameras, camera modules and other imaging devices based on CCD or CMOS technology can additionally or alternatively be used as one or more of the sensors 115A-115D. According to one embodiment, not only the player but objects on or carried by the player can be detected by the sensors 115A-115D. For example, the sensors 115A-115D may comprise Radio Frequency Identification (RFID) readers which can detect RFID tags embedded in a card, fob, etc. carried by the player. Additionally, or alternatively, one or more sensors 115A-115D may detect a mobile device of the player using Near Field Communications (NFC) or other short range communications technologies.

The presence and location of a player relative to one of the display devices 110A-110D can be detected based on the electrical signal from one of the sensors 115A-115D and an instance of the electronic game present on one or more of the display devices 110A-110D. An orientation of the instance of the electronic game as presented on the display devices 110A-110D can be dynamically adapted based on the detected presence and location of the player relative to the display devices 110A-110D. That is, one or more of the display devices 110A-110D can be selected to present the instance of the game based on which of the sensors 115A-115D detected the player and the orientation and/or size of the instance of the game can be adapted to display on the selected one or more display devices 110A-110D. The game instance can then be executed and conducted through the one or more display devices 110A-110D. According to one embodiment, the display devices 110A-110D can comprise touch sensitive displays and the player can interact with and/or control the game instance, e.g., place wagers, select options, take other actions, etc., through touch gestures on the display device 110A-110D.

According to one embodiment, the furnishing 100 can further comprise a wireless communications interface 120, e.g., a Near Field Communications (NFC) and/or Bluetooth Low Energy (BLE) transceiver, mounted beneath or within the display devices 115A-115D or elsewhere on the furnishing 100. Information indicating an account of the player used to fund game play credit for the electronic game can be received through the wireless communications interface 120, e.g., from a mobile device of the player executing a casino or mobile wallet application.

According to one embodiment, the furnishing 100 can be adapted to communicatively connect with another, nearby or physically adjoining furnishing. For example, the furnishing 100 can detect a second piece of furniture or other furnishing (not shown here), e.g., through the wireless communications interface 120. Additionally, or alternatively, the furnishing 100 can include a wired communications interface including a wired connection 125 through which the furnishing can be physically and electrically connected with another furnishing (now shown here). In either case, the furnishing can be communicatively connected with the other piece of furniture or furnishing and instance of the electronic game presented on display devices 110A-110D of the furnishings can be coordinated. For example, players at the different furnishings can participate in a competitive tournament in which the players play the electronic game against each other, e.g., a video poker tournament. In other cases, coordinating the instances of the electronic game can comprise conducting a player pool in which each player contributes some amount of game play credit, i.e., pays into the pool, and where the game play credit available in the pool, and perhaps winnings, if any, can be shared between the participating players.

In some cases, the display devices 110A-110D can comprise touch sensitive displays. In such cases, players can interact with the instances of the electronic games presented on the display devices 110A-110D through common gestures, e.g., tap, drag and drop, pinch, etc. Coordination of the presented instances of electronic game can also be based on such gestures. For example, a player may drag and drop a graphical representation of a game piece, chip, card, etc. to another display device 110A-110D. Additionally, or alternatively, a player may drag and drop an entire instance of the electronic game from a display device 110A on which it is currently being presented to another display device 110D when the player wants to more to a different location around the furnishing 100.

Figure 2A:
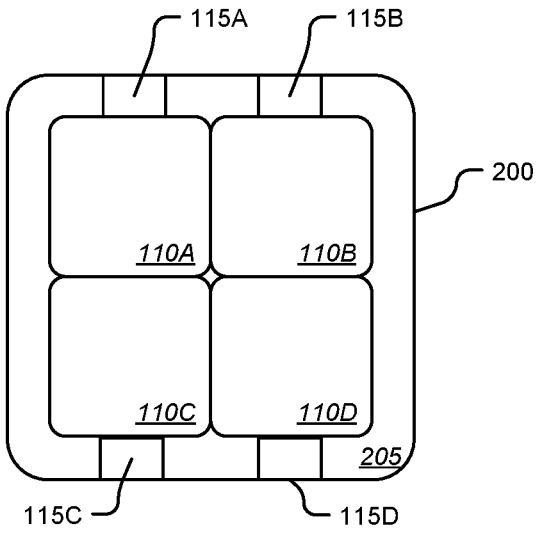
FIGS. 2A and 2B are illustrations of various views of an exemplary furnishing according to another embodiment of the present disclosure.
Figure 2B:
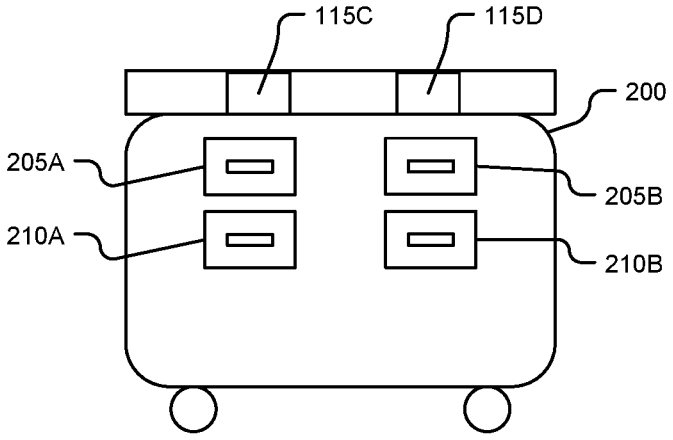

FIGS. 2A and 2B are illustrations of various views of an exemplary furnishing according to another embodiment of the present disclosure. More specifically, FIG. 2A illustrates a top view of a furnishing 200, specifically ab ottoman, in which an electronic gaming machine can be implemented while FIG. 2B illustrates a side view of the same ottoman. As illustrated in this example, a furnishing 200 can comprise one or more display devices 110A-110D disposed on a player accessible surface 105 of the furnishing 100, in this case, the top surface as described above, i.e., the one or more display devices 110A-110D can be mounted on the player accessible surface 105 of the table and can appear to be the glass on the table top. In other implementations, a single display device may be used which can be logically divided into different portions equivalent to the display devices 110A-110D as illustrated here and which can be controlled separately as if they were different physical devices and as will be described herein.

Also as described above, one or more sensors 115A-115D, such as motion sensors, can be disposed in the furnishing 200 at different locations. For example, the sensors 115A-115D can be mounted on or embedded in an edge of the table top as illustrated here. The sensors 115A-115D can be positioned so that a detection zone or the sensor can cover a position at which a player or spectator would sit or stand if playing or watching a game on one or the display devices 110A-110D. Each sensor 115A-115D can provide an electrical signal indicating a presence of a player within a predetermined distance of the display device and a location of the player relative to the display device 110A-110D.

The presence and location of a player relative to one of the display devices 110A-110D can be detected based on the electrical signal from one of the sensors 115A-115D and an instance of the electronic game present on one or more of the display devices 110A-110D. An orientation of the instance of the electronic game as presented on the display devices 110A-110D can be dynamically adapted based on the detected presence and location of the player relative to the display devices 110A-110D. The game instance can then be executed and conducted through the one or more display devices 110A-110D. As noted above, the display devices 110A-110D can, in some cases, comprise touch sensitive displays and the player can interact with and/or control the game instance, e.g., place wagers, select options, take other actions, etc., through touch gestures on the display device 110A-110D.

Also as described above, the furnishing 200 can further comprise a wireless communications interface (not illustrated here), e.g., a Near Field Communications (NFC) and/or Bluetooth Low Energy (BLE) antenna(s). Information indicating an account of the player used to fund game play credit for the electronic game can be received through the wireless communications interface, e.g., from a mobile device of the player executing a casino or mobile wallet application. Additionally, or alternatively, the furnishing 200 illustrated here as well as the furnishing 100 described above with reference to FIGS. 1A and 1B can comprise one or more card readers 205A and 205B and/or one more ticket readers 210A and 210B. In such cases, the card readers 205A and 205B can be used to read account information from a card of the player, e.g., account information from a casino card, credit card, debit card, etc. used to fund game play credit. The ticket printers 210A and 210B can be used to output information indicating a payout to the player based on a result of the electronic game, e.g., a printed ticket indicating winnings collectable when presented to a teller or cashier.

As with the furnishing 100 described above, the furnishing 200 illustrated in FIGS. 2*a* and 2B and described here can be adapted to communicatively connect with another, nearby or physically adjoining furnishing. For example, the furnishing 200 can detect a second piece of furniture or other furnishing (not shown here), e.g., through a wireless communications interface (not shown here) on or within the furnishing 200. Additionally, or alternatively, the furnishing 200 can include a wired communications interface including a wired connection (not shown here) through which the furnishing can be physically and electrically connected with another furnishing (now shown here). In either case, the furnishing can be communicatively connected with the other piece of furniture or furnishing and instance of the electronic game presented on display devices 110A-110D of the furnishings can be coordinated as described above.

Figure 3:
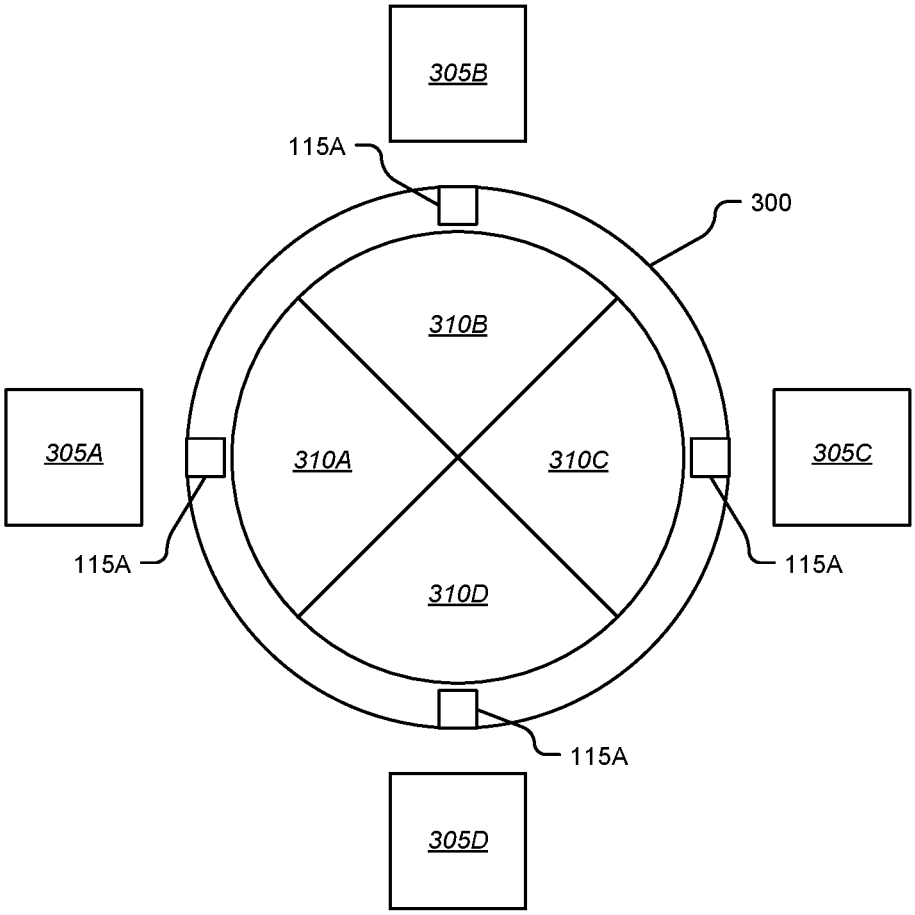
FIG. 3 is an illustration of an exemplary furnishing according to yet another embodiment of the present disclosure.

FIG. 3 is an illustration of an exemplary furnishing according to yet another embodiment of the present disclosure. In this example, the furnishing 300, whether a table, ottoman, or other furnishing, is substantially round or circular. Similar to the examples described above and as illustrated in this example, the furnishing 300 can comprise one or more display devices 310A-310D disposed on a player accessible surface of the furnishing 300. In other implementations, a single display device may be used which can be logically divided into different portions equivalent to the display devices 310A-310D as illustrated here and which can be controlled separately as if they were different physical devices and as will be described herein.

Also as described above, one or more sensors 115A-115D, such as motion sensors, can be disposed in the furnishing 300 at different locations. For example, the sensors 115A-115D can be mounted on or embedded in an edge of a table top or ottoman. The sensors 115A-115D can be positioned so that a detection zone or the sensor can cover a position 305A-305D, such as a seat or chair, at which a player or spectator would sit or stand if playing or watching a game on one or the display devices 110A-110D. Each sensor 115A-115D can provide an electrical signal indicating a presence of a player within a predetermined distance of the display device and a location of the player relative to the display device 110A-110D.

The presence and location of a player relative to one of the display devices 310A-310D can be detected based on the electrical signal from one of the sensors 115A-115D and an instance of the electronic game present on one or more of the display devices 310A-310D. An orientation of the instance of the electronic game as presented on the display devices 310A-310D can be dynamically adapted based on the detected presence and location of the player relative to the display devices 310A-110D. The game instance can then be executed and conducted through the one or more display devices 310A-310D. As noted above, the display devices 310A-310D can, in some cases, comprise touch sensitive displays and the player can interact with and/or control the game instance, e.g., place wagers, select options, take other actions, etc., through touch gestures on the display device 310A-310D. Additionally, or alternatively, the presentation of electronic game instances on the display devices 310A-310D can be coordinated. For example, the presentation can be coordinated to display a spinning roulette wheel or provide a graphical representation of a card or chip being passed to or from one or more of the players.

While some examples of furnishings 110, 200, 300 are provided here, these should not be considered to be an exhaustive list. Rather numerous variations are contemplated and considered to be within the scope of the present invention. For example, embodiments of a furnishing as described herein can also include, but are not limited to, a desk, a countertop, a picture or display hung on a wall, a window, a wall or partition, etc. Additionally, the various functions described herein with reference to any particular type of furnishing or a particular embodiment should be considered to be interchangeable between any embodiment or type of furnishing contemplated.

Figure 4A:
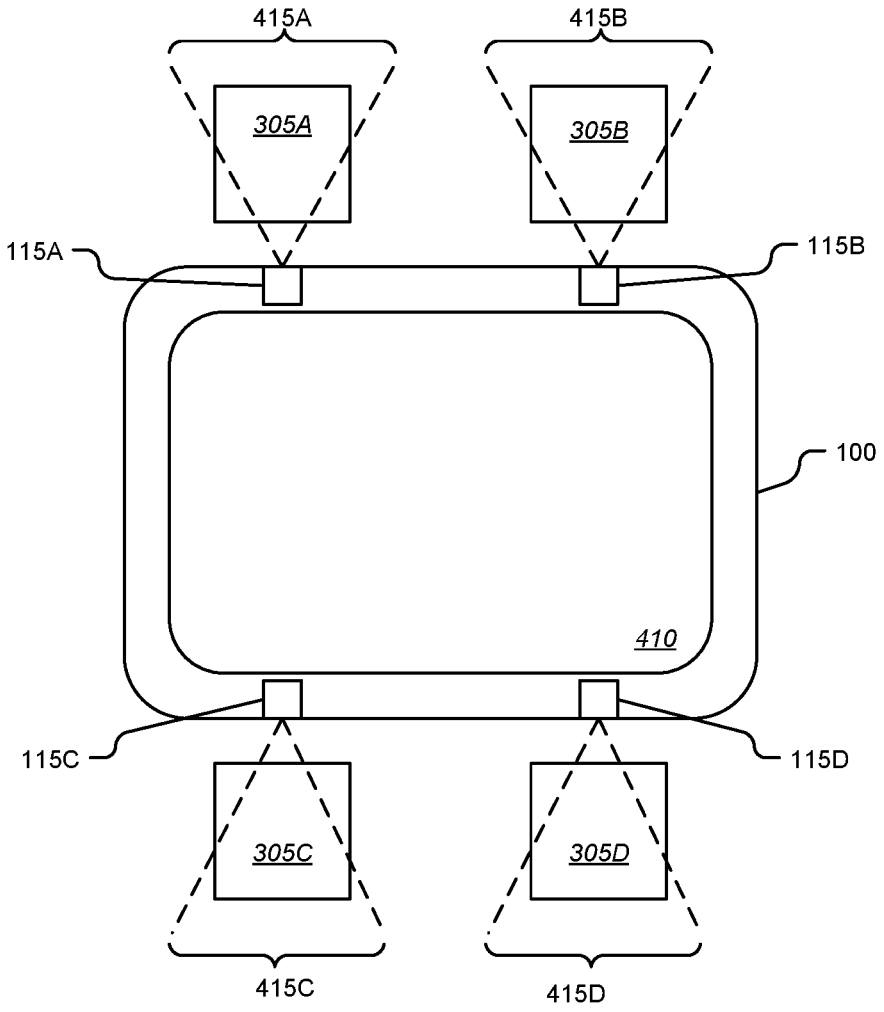
FIG. 4A-4C illustrate examples of detecting presence and location of a player and presenting game instances on a furnishing which are oriented based on the presence and location of the player according to one embodiment of the present disclosure.
Figure 4B:
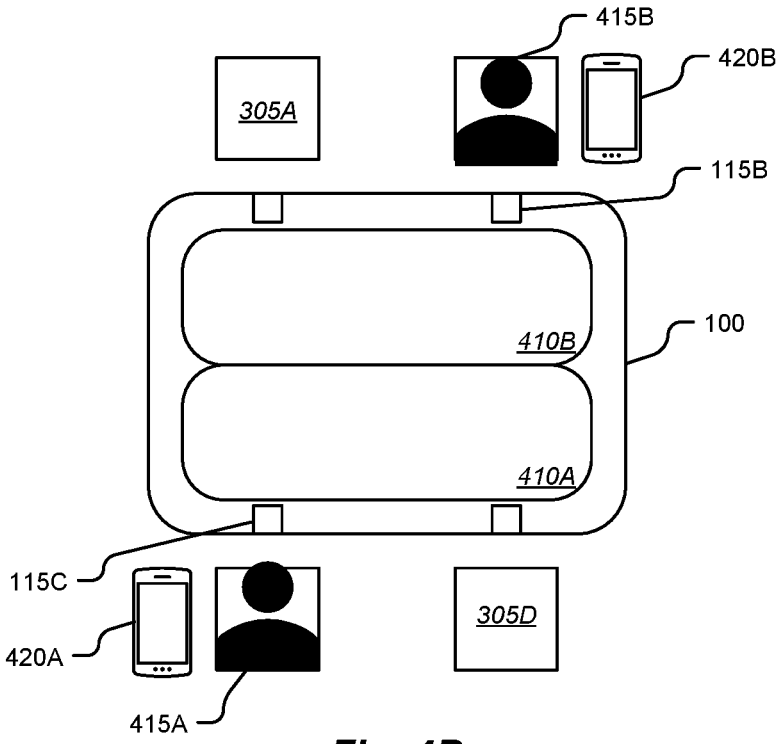
Figure 4C:
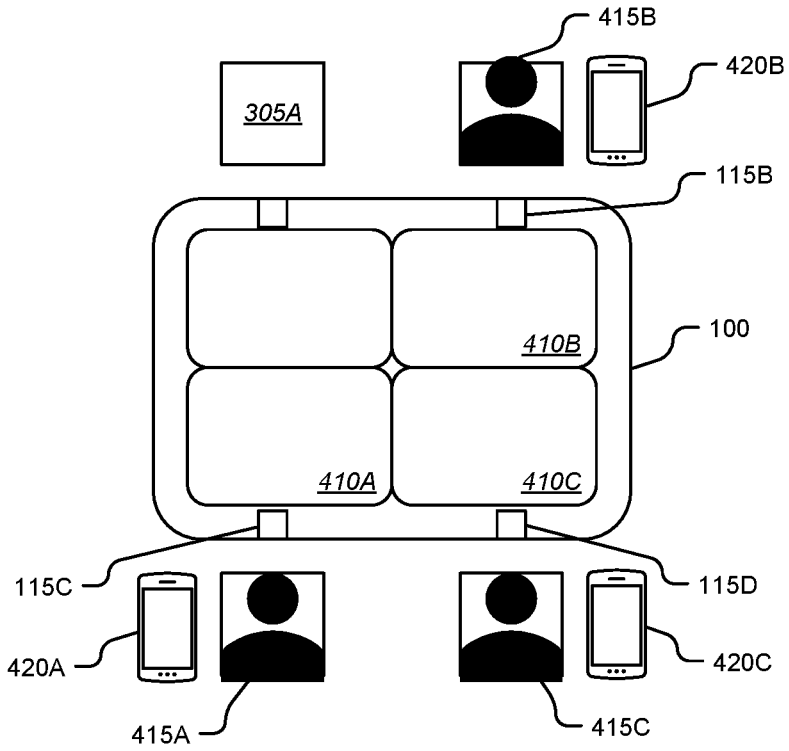

FIG. 4A-4C illustrate examples of detecting presence and location of a player and presenting game instances on a furnishing which are oriented based on the presence and location of the player according to one embodiment of the present disclosure. More specifically, FIG. 4A illustrates a furnishing 100 such as a table as described above as seen from above and including an initial display 410 which can be presented on the one or more display devices 110A-110D described above. Also as described above, sensors 115A-115D, such as motion sensors, can be disposed in the furnishing 100 at different locations. For example, the sensors 115A-115D can be mounted on or embedded in an edge of the table top. Each sensor 115A-115D can be positioned so that a detection zone 415A-415D of the sensor can cover a position 305A-305D at which a player or spectator would sit or stand if playing or watching a game on the furnishing 100. Each sensor 115A-115D can provide an electrical signal indicating a presence of a player within a predetermined distance of the furnishing 100 and a location of the player relative to the furnishing 100, i.e., within the detection zone 415A-415D of a sensor 115A-115D.

When no players are detected, the initial display 410 can cover most or all of the top, player accessible surface 105 of the furnishing 100. This initial display 410 can include, for example, text, graphics, visual effects, etc. to draw attention to the electronic game available on the furnishing, provide instructions or demonstrations for the electronic game. In other cases, the initial display 410 can present pictures, videos, etc. for entertainment, esthetics, etc. In yet other cases, the display devices 110A-110D may remain off and the initial display 410 can therefore appear as part of the glass top of the furnishing 100.

As illustrated in FIGS. 4B and 4C, the sensors 115B and 115C can detect players 415A and 415C that sit down at or approach the furnishing 100. The content presented on the display devices 110A-110D can be dynamically adapted, e.g., the content of the initial display 410 can change including being resized and reoriented and instances of the electronic game 410A and 410B can be presented to each player 415A and 415B through the display devices 11A-110D. When an additional player 415C approaches or sits at the furnishing 100, as detected by a sensor 115D, the presented instances of the electronic game 410A and 410B can be resized and an additional instance of the electronic game 410C can be presented.

As noted above, the furnishing 100 can further comprise a wireless communications interface 120, e.g., an NFC and/or BLE transceiver, mounted beneath or within the display devices 115A-115D or elsewhere on the furnishing 100. Through the wireless communications interface 120, the furnishing can communicatively connect with a mobile device 420A-420C of the players. Information indicating an account of the player used to fund game play credit and/or pay out winnings for the electronic game can be received through the wireless communications interface 120, e.g., from the mobile device 420A-420C of the player executing a casino or mobile wallet application.

According to one embodiment, if a player 420A is not focused on the game, as determined based on the player's 420A interaction with the presented electronic game instance 410A, or lack thereof, the electronic game instance 410A can be altered. For example, the electronic game instance 410A can be paused or can enter casual mode in which a preset bet limit for the electronic game that casual plays in the background while the player converses with someone else or is otherwise distracted. When a player 415B leaves or moves away from the furnishing as detected by a sensor 115B, the electronic game instance 410B presented to the player 415B can enter a pause state that can last for an operator or player predetermined amount of time. If the player 415B does not return within the predetermined amount of time, the electronic game instance 410B presented to that play can end, logging the player out, and crediting the player's 415B account with any credits remaining.

Figure 5:
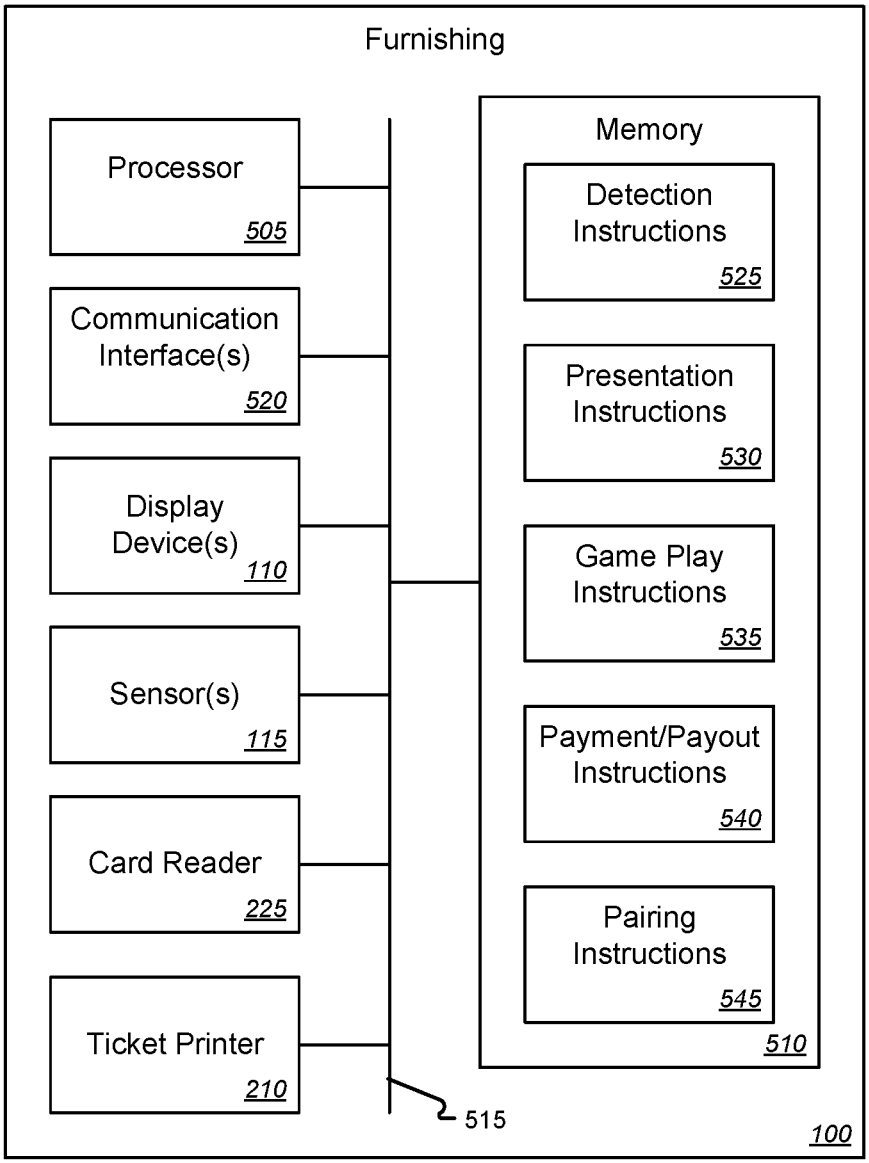
FIG. 5 is a block diagram illustrating various components of an exemplary furnishing according to one embodiment of the present disclosure.

FIG. 5 is a block diagram illustrating various components of an exemplary furnishing according to one embodiment of the present disclosure. As illustrated in this example, a furnishing 100 can comprise a processor 505. The processor 505 may correspond to one or many computer processing devices. For instance, the processor 505 may be provided as silicon, as a Field Programmable Gate Array (FPGA), an Application-Specific Integrated Circuit (ASIC), any other type of Integrated Circuit (IC) chip, a collection of IC chips, or the like. As a more specific example, the processor 505 may be provided as a microprocessor, Central Processing Unit (CPU), or plurality of microprocessors that are configured to execute the instructions sets stored in a memory 510. Upon executing the instruction sets stored in memory 510, the processor 505 enables various functions of the furnishing 100 as described herein.

The memory 510 can be coupled with and readable by the processor 505 via a communications bus 515. The memory 510 may include any type of computer memory device or collection of computer memory devices. Non-limiting examples of memory 510 include Random Access Memory (RAM), Read Only Memory (ROM), flash memory, Electronically-Erasable Programmable ROM (EEPROM), Dynamic RAM (DRAM), etc. The memory 510 may be configured to store the instruction sets depicted in addition to temporarily storing data for the processor 505 to execute various types of routines or functions.

The processor 505 can also be coupled with one or more communication interfaces 520 via the communications bus 515. The communication interfaces 520 can comprise, for example, a NFC, BLE, WiFi, cellular, and/or other type of wireless communications interface. Additionally, or alternatively, the communications interfaces 520 can comprise one or more wired interfaces including but not limited to a Universal Serial Bus (USB) 2.0 or 3.0 interface, for example. The furnishing 100 can further comprise one or more displays 110, sensors 115 disposed at different locations on the furnishing, a card reader 225, and/or a ticket printer 210 each as described above and communicatively coupled with the processor 505 through the communications bus 515.

The memory 510 can store therein sets of instructions which, when executed by the processor 505, cause the processor 505 to provide an electronic game through the furnishing as described herein. For example, the memory 510 can store a set of detection instructions 525 which, when executed by the processor 505, can cause the processor 505 to receive an electrical signal from a sensor 115. As described, the electrical signal can indicate a presence of a player 415 within a predetermined distance of the display device 110 and a location of the player 415 relative to the display device 110. The detection instructions 525 can further cause the processor 505 to detect the presence of the player 415 within the predetermined distance of the display device and the location of the player relative to the display device based on the electrical signal.

The memory 510 can also store a set of presentation instructions 530 and a set of game play instructions 535. Generally speaking, the game play instructions 535, when executed by the processor 505, can cause the processor 505 to generate and execute instances of an electronic game. The presentation instructions 530, when executed by the processor 505, can cause the processor 505 to present a generated instance of the electronic game on the display device 110. An orientation of the instance of the electronic game as presented on the display device 110 can be dynamically adapted based on the detected presence of the player 415 within the predetermined distance of the display device 110 and the location of the player 415 relative to the display device 110.

The memory 510 can also store a set of payment/payout instructions 540. Generally speaking, the payment/payout instructions 540, when executed by the processor 505, can cause the processor 505 to receive, through the communications interface, e.g., wirelessly from a mobile device 420 of the player 415, information indicating an account of the player used to fund game play credit and/or payout winnings for the electronic game. Additionally, or alternatively, the payment/payout instructions 540 can cause the processor 505 to read account information from a card of the player via the card reader 225, the account information identifying a financial account of the player 415 used to fund game play credit for the electronic game. The payment/payout instructions 540 can additionally or alternatively cause the processor 505 to output, through the ticket printer 210, information indicating a payout to the player 415 based on a result of the electronic game.

According to one embodiment, the detection instructions 525, when executed by the processor 505, can further cause the processor 505 to determine, based on the electrical signal from the sensor 115, that the player 415 is moving away from the display device 110. In response to determining that the player 415 is moving away from the display device 110, the detection instructions 525 can cause the processor to pause the instance of the electronic game for up to a predetermined amount of time and determine, based on the electrical signal from the sensor 115, whether the player 415 has returned to the display device 110. In response to determining the player 415 has returned to the display device before expiration of the predetermined amount of time, the detection instructions 525 can cause the processor 505 to resume the instance of the electronic game. In response to determining the player 415 has not returned to the display device before expiration of the predetermined amount of time, the detection instructions 525 can cause the processor to end the instance of the electronic game. In some cases, in response to determining that the player 415 is moving away from the display device 110 and before pausing the instance of the electronic game, the detection instructions 525 can cause the processor 505 to present a message on the display device 110, the message asking if the player will return, and receive, an answer to the presented message. In response to the received answer indicating the player will not return, the detection instructions can cause the processor 505 to end the instance of the electronic game before expiration of the predetermined amount of time.

According to one embodiment, the detection instructions 525, when executed by the processor 505, can additionally or alternatively cause the processor 505 to determine that the player 415 is not paying attention to the instance of the electronic game. This determination can be based on interaction of the player 415 with the instance of the electronic game. In response to determining the player is not paying attention to the instance of the electronic game, the detection instructions 525 can cause the processor to alter game play of the instance of the electronic game, e.g., by pausing, entering a casual or automatic mode, etc.

As noted above, the furnishing 100 can comprise a first of a plurality of pieces of furniture and wherein the instance of the electronic game presented on the display device of the first piece of furniture comprises a first instance of a plurality of instances of the electronic game. Accordingly, the memory 510 can have stored therein a set of pairing instructions 545 which, when executed by the processor 505, causes the processor 505 to detect a second piece of furniture of the plurality of pieces of furniture, the second piece of furniture presenting on a display device of the second piece of furniture a second instance of the electronic game, communicatively connect the first piece of furniture with the second piece of furniture through the communications interface 520, and coordinate the first instance of the electronic game with the second instance of the electronic game. Coordinating the first instance of the electronic game with the second instance of the electronic game can comprise conducting a tournament between the first player and the second player, conducting a player pool between the first player and the second player, and/or presenting a visual effect as described above.

Figure 6:
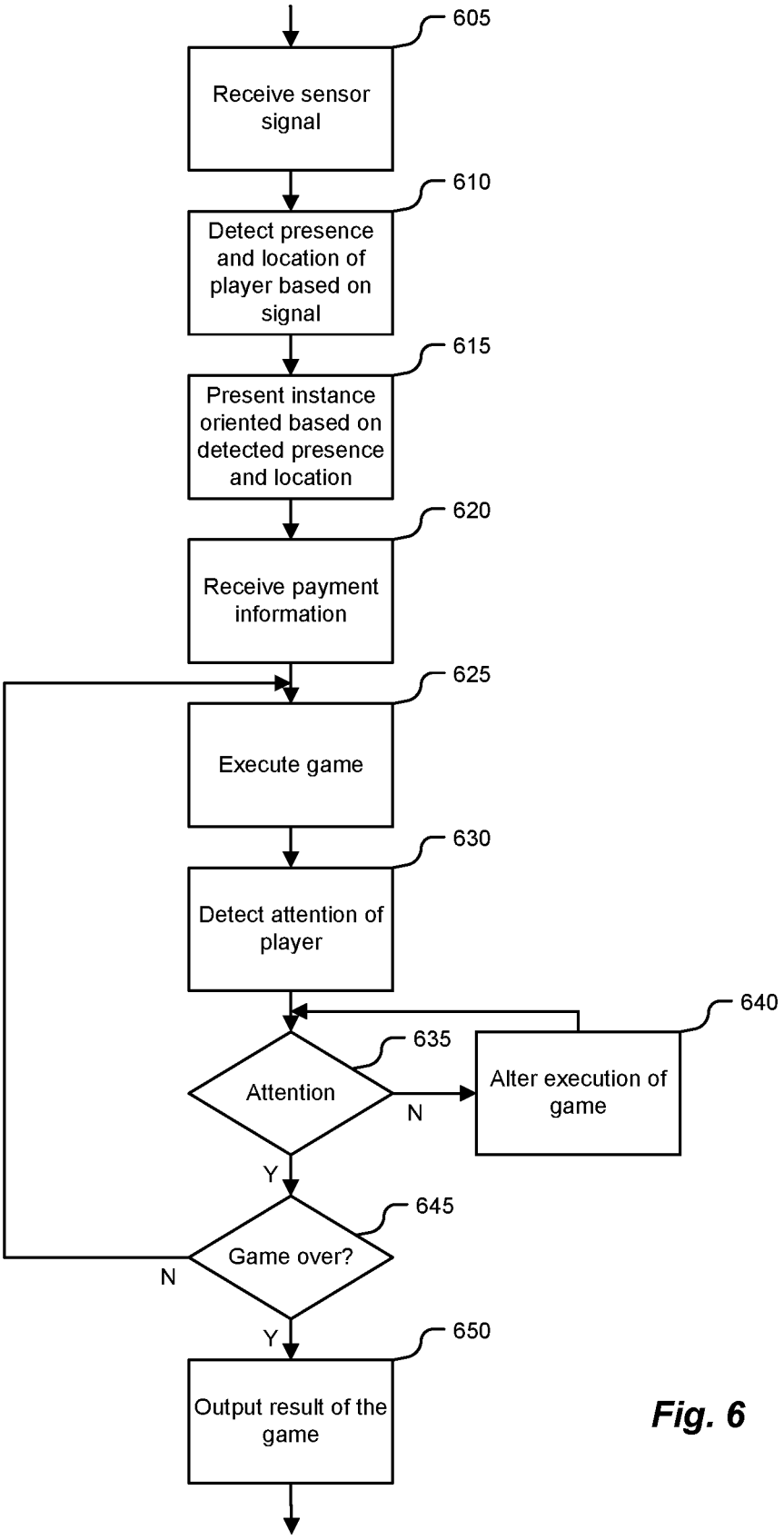
FIG. 6 is a flowchart illustrating an exemplary process for providing an electronic game through a furnishing according to one embodiment of the present disclosure.

FIG. 6 is a flowchart illustrating an exemplary process for providing an electronic game through a furnishing according to one embodiment of the present disclosure. As illustrated in this example, providing an electronic game through a display device disposed within and forming a surface of a furnishing can comprise receiving 605 an electrical signal from a sensor of a plurality of sensors, each sensor of the plurality of sensors disposed at a different location on the furnishing. The electrical signal can indicate a presence of a player within a predetermined distance of the display device and a location of the player relative to the display device. The presence of the player within the predetermined distance of the display device and the location of the player relative to the display device can be detected based on the received electrical signal.

An instance of the electronic game can be presented 615 on the display device. An orientation of the instance of the electronic game as presented on the display device can be dynamically adapted based on the detected presence of the player within the predetermined distance of the display device and the location of the player relative to the display device. That is, the orientation and/or size of the presented electronic game instance can be adjusted based on the location of the player and other players around the furnishing.

Information indicating an account of the player used to fund game play credit for the electronic game can be received 620. This information can be received 620, for example, through a wireless communications interface from a mobile device of the player. In other cases, the information can be received 620 from a card of the player via the card reader.

The presented 615 instance of the electronic game can be executed 625 and, during execution of the instance of the electronic game, attention of the player can be detected 630, e.g., based on the players interactions with the instance of the electronic game. A determination 635 can be made as to whether the player is paying attention to the instance of the electronic game based on interaction of the player with the instance of the electronic game. In response to determining 635 the player is not paying attention to the instance of the electronic game, game play of the instance of the electronic game can be altered 640, e.g., by pausing, entering a casual or automatic mode, etc.

If or when a determination 635 is made that the player is paying attention to the presented instance of the electronic game, a further determination 645 can be made as to whether the instance of the electronic game is over or is ongoing. If a determination 645 is made that the instance of the electronic game is not over, executing 625 the instance of the electronic game and detecting 630 the attention of the player can continue until a determination 645 is made that the instance of the electronic game is over. In response to determining 645 that the instance of the electronic game is over, a result of the game can be output 650. For example, winnings can be credited to the account of the player, a redeemable ticket indicating winnings can be printed, etc.

Figure 7:
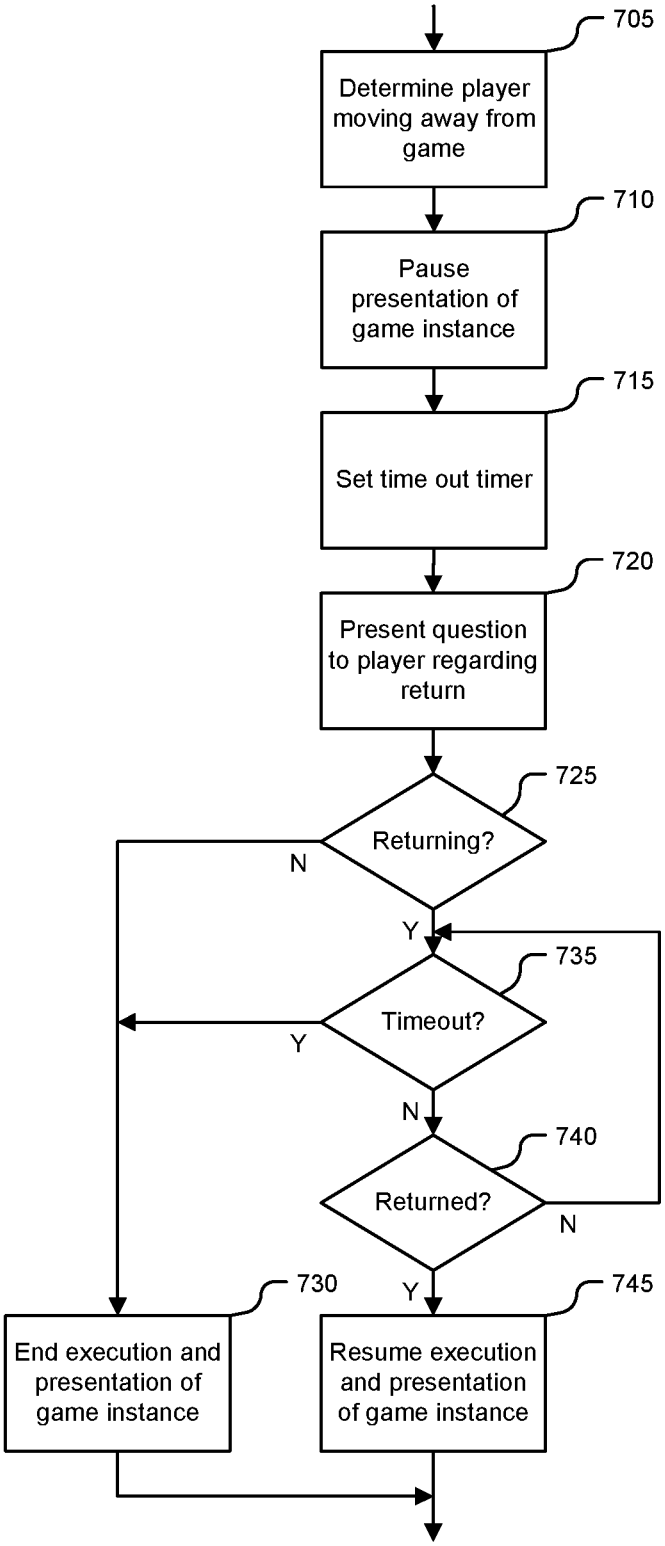
FIG. 7 is a flowchart illustrating additional details of a process for providing an electronic game through a furnishing according to one embodiment of the present disclosure.

FIG. 7 is a flowchart illustrating additional details of a process for providing an electronic game through a furnishing according to one embodiment of the present disclosure. During execution of an instance of an electronic game, as illustrated in this example, it can be determined 705 the player is moving away from the display device can be based on the electrical signal from the sensor in the furnishing. In response to determining 705 that the player is moving away from the display device, the instance of the electronic game can be paused 710 for up to a predetermined amount of time and a timer for this predetermined amount of time can be set 715.

In some cases, in response to determining 705 that the player is moving away from the display device, a message can be presented 720 on the display device asking if the player will return and a determination 725 can be made based on a received answer to the presented message. In response to determining 725 the received answer indicates the player will not return, execution and presentation of the instance of the electronic game can be ended 730 before expiration of the predetermined amount of time.

In response to determining 725 the received answer indicates the player will return, a determination 735 can be made as to whether the timer set to the predetermined amount of time has expired. In response to determining 735 whether the predetermined amount of time has not expired, a further determination 740 can be made as to whether the player has returned. In response to determining not returned, the determination 735 as to whether the predetermined amount of time can again be made. Once a determination 740 is made that the player has not returned and a determination 735 that the predetermined amount of time has expired is made, execution and presentation of the instance of the electronic game can be ended 730. However, if a determination 735 is made that the predetermined amount of time has not yet expired and a determination 740 is made that the player has returned is made, execution and presentation of the instance of the electronic game can resume 745.

Figure 8:
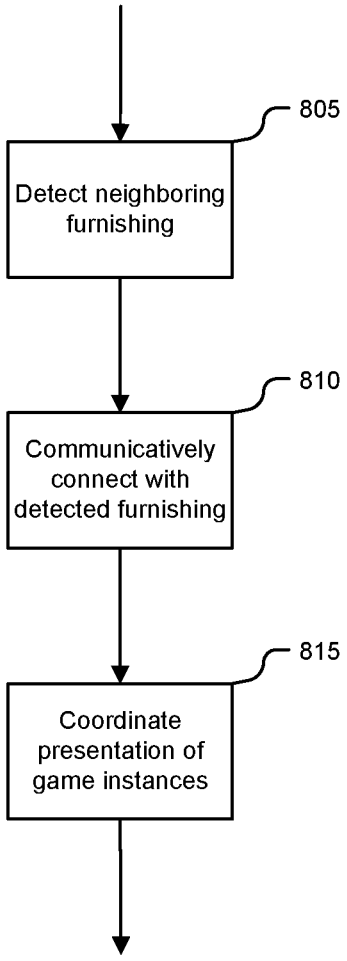
FIG. 8 is a flowchart illustrating an exemplary process for providing an electronic game through a plurality of furnishings according to one embodiment of the present disclosure.

FIG. 8 is a flowchart illustrating an exemplary process for providing an electronic game through a plurality of furnishings according to one embodiment of the present disclosure. As illustrated in this example, providing an electronic game through a plurality of furnishings can comprise detecting 805, by a first furnishing, a second furnishing of the plurality of furnishing, e.g., through a wireless of wired communications interface. The first furnishing can be communicatively connected 810 with the second furnishing through the wireless or wired communications interface. A presentation of a first instance of an electronic game on the first furnishing can be coordinated with a presentation of a second instance of the electronic game on the second furnishing.

The term "a" or "an" entity refers to one or more of that entity. As such, the terms "a" (or "an"), "one or more," and "at least one" can be used interchangeably herein. It is also to be noted that the terms "comprising," "including," and "having" can be used interchangeably.

As will be appreciated by one skilled in the art, aspects of the present disclosure may be illustrated and described herein in any of a number of patentable classes or context including any new and useful process, machine, manufacture, or composition of matter, or any new and useful improvement thereof. Accordingly, aspects of the present disclosure may be implemented entirely hardware, entirely software (including firmware, resident software, microcode, etc.) or combining software and hardware implementation that may all generally be referred to herein as a "circuit," "module," "component," or "system." Furthermore, aspects of the present disclosure may take the form of a computer program product embodied in one or more computer readable media having computer readable program code embodied thereon.

Any combination of one or more computer readable media may be utilized. The computer readable media may be a computer readable signal medium or a computer readable storage medium. A computer readable storage medium may be, for example, but not limited to, an electronic, magnetic, optical, electromagnetic, or semiconductor system, apparatus, or device, or any suitable combination of the foregoing. More specific examples (a non-exhaustive list) of the computer readable storage medium would include the following: a portable computer diskette, a hard disk, a random access memory (RAM), a read-only memory (ROM), an erasable programmable read-only memory (EPROM or Flash memory), an appropriate optical fiber with a repeater, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device. Program code embodied on a computer readable signal medium may be transmitted using any appropriate medium, including but not limited to wireless, wireline, optical fiber cable, RF, etc., or any suitable combination of the foregoing.

Computer program code for carrying out operations for aspects of the present disclosure may be written in any combination of one or more programming languages, including an object oriented programming language such as Java, Scala, Smalltalk, Eiffel, JADE, Emerald, C++, C#, VB.NET, Python or the like, conventional procedural programming languages, such as the "C" programming language, Visual Basic, Fortran 2003, Perl, COBOL 2002, PHP, ABAP, dynamic programming languages such as Python, Ruby and Groovy, or other programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider) or in a cloud computing environment or offered as a service such as a Software as a Service (SaaS).

Aspects of the present disclosure are described herein with reference to flowchart illustrations and/or block diagrams of methods, apparatuses (systems) and computer program products according to embodiments of the disclosure. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable instruction execution apparatus, create a mechanism for implementing the functions/acts specified in the flowchart and/or block diagram block or blocks.

These computer program instructions may also be stored in a computer readable medium that when executed can direct a computer, other programmable data processing apparatus, or other devices to function in a particular manner, such that the instructions when stored in the computer readable medium produce an article of manufacture including instructions which when executed, cause a computer to implement the function/act specified in the flowchart and/or block diagram block or blocks. The computer program instructions may also be loaded onto a computer, other programmable instruction execution apparatus, or other devices to cause a series of operational steps to be performed on the computer, other programmable apparatuses or other devices to produce a computer implemented process such that the instructions which execute on the computer or other programmable apparatus provide processes for implementing the functions/acts specified in the flowchart and/or block diagram block or blocks.

The invention is claimed as follows:

1. A furnishing comprising:

a display device disposed on a player accessible surface of the furnishing;

a first sensor providing an electrical signal indicating a presence of a first player of an electronic game within a predetermined distance of the display device and a location of the first player relative to the display device;

a second sensor providing an electrical signal indicating a presence of a second player of the electronic game within a predetermined distance of the display device and a location of the second player relative to the display device;

a processor coupled with the display device, the first sensor, and the second sensor; and a memory coupled with and readable by the processor and storing therein a set of instructions which, when executed by the processor, causes the processor to:

receive the electrical signal from the first sensor;

detect the presence of the first player within the predetermined distance of the display device and the location of the first player relative to the display device based on the electrical signal;

present a first instance of the electronic game on the display device, wherein an orientation of the first instance of the electronic game as presented on the display device is dynamically adapted based on the detected presence of the first player within the predetermined distance of the display device and the location of the first player relative to the display device, and wherein the first instance of the electronic game provides interaction with the electronic game to the first player;

receive the electrical signal from the second sensor;

detect the presence of the second player within the predetermined distance of the display device and the location of the second player relative to the display device based on the electrical signal;

present a second instance of the electronic game on the display device, wherein an orientation of the second instance of the electronic game as presented on the display device is dynamically adapted based on the detected presence of the second player within the predetermined distance of the display device and the location of the second player relative to the display device, and wherein the second instance of the electronic game provides interaction with the electronic game to the second player; and coordinate the first instance of the electronic game with the second instance of the electronic game based on interaction with the electronic game by the first player or the second player.

2. The furnishing of claim 1, wherein the first sensor and the second sensor are disposed at different locations on the furnishing.

3. The furnishing of claim 1, further comprising a wireless communications interface coupled with the processor and wherein the instructions further cause the processor to receive, through the wireless communications interface, from a mobile device of the first player, information indicating an account of the first player used to fund game play credit for the electronic game.

4. The furnishing of claim 1, further comprising a card reader coupled with the processor, wherein the instructions further cause the processor to read account information from a card of the first player via the card reader, the account information identifying a financial account of the first player used to fund game play credit for the electronic game.

5. The furnishing of claim 1, further comprising a ticket printer coupled with the processor, wherein the instructions further cause the processor to output, through the ticket printer, information indicating a payout to the first player based on a result of the electronic game.

6. The furnishing of claim 1, wherein the instructions further cause the processor to:

determine, based on the electrical signal from the first sensor, that the first player is moving away from the display device;

in response to determining that the first player is moving away from the display device, pause the first instance of the electronic game for up to a predetermined amount of time;

determine, based on the electrical signal from the sensor, whether the first player has returned to the display device;

in response to determining the first player has returned to the display device before expiration of the predetermined amount of time, resume the first instance of the electronic game; and in response to determining the first player has not returned to the display device before expiration of the predetermined amount of time, end the first instance of the electronic game.

7. The furnishing of claim 1, wherein the furnishing comprises a table.

8. The furnishing of claim 1, wherein the furnishing comprises an ottoman.

9. The furnishing of claim 1, wherein the player accessible surface of the furnishing comprises a top surface.

10. The furnishing of claim 1, wherein the furnishing comprises a first piece of furniture of a plurality of pieces of furniture, wherein each piece of furniture of the plurality of pieces of furniture comprises a communications interface, and wherein the instructions further cause the processor to:

detect a second piece of furniture of the plurality of pieces of furniture, the second piece of furniture presenting on a display device of the second piece of furniture a third instance of the electronic game to a third player of the electronic game, wherein the third instance of the electronic game provides interaction with the electronic game to the third player;

communicatively connect the first piece of furniture with the second piece of furniture through the communications interface; and coordinate the first instance of the electronic game, the second instance of the electronic game, and the third instance of the electronic game based on interaction with the electronic game by the first player, second player, or third player.

11. An electronic gaming machine comprising:

a furnishing having a player accessible surface;

a first display device disposed on the player accessible surface and forming a first portion of the player accessible surface;

a first sensor disposed at a first location on the furnishing and providing an electrical signal indicating a presence of a first player of an electronic game within a predetermined distance of the first display device and a location of the first player relative to the first display device;

a second display device disposed on the player accessible surface and forming a second portion of the player accessible surface;

a second sensor disposed at a second location and providing an electrical signal indicating a presence of a second player of the electronic game within a predetermined distance of the second display device and a location of the second player relative to the second display device;

a processor coupled with each of the first display device, the second display device, the first sensor, and the second sensor; and a memory coupled with and readable by the processor and storing therein a set of instructions which, when executed by the processor, causes the processor to:

receive the electrical signal from the first sensor;

detect the presence of the first player within the predetermined distance of the first display device and the location of the first player relative to the first display device based on the electrical signal from the first sensor;

present a first instance of the electronic game on the first display device, wherein an orientation of the first instance of the electronic game as presented on the first display device is dynamically adapted based on the detected presence of the first player within the predetermined distance of the first display device and the location of the first player relative to the first display device, and wherein the first instance of the electronic game provides interaction with the electronic game to the first player;

receive the electrical signal from the second sensor;

detect the presence of the second player within the predetermined distance of the second display device and the location of the second player relative to the second display device based on the electrical signal from the second sensor;

present a second instance of the electronic game on the second display device, wherein an orientation of the second instance of the electronic game as presented on the second display device is dynamically adapted based on the presence of the second player within the predetermined distance of the second display device and the location of the second player relative to the second display device, and wherein the second instance of the electronic game provides interaction with the electronic game to the second player; and coordinate the first instance of the electronic game with the second instance of the electronic game based on interaction with the electronic game by the first player or the second player.

12. The electronic gaming machine of claim 11, wherein coordinating the first instance of the electronic game with the second instance of the electronic game comprises conducting a tournament between the first player and the second player.

13. The electronic gaming machine of claim 11, wherein coordinating the first instance of the electronic game with the second instance of the electronic game comprises conducting a player pool between the first player and the second player.

14. The electronic gaming machine of claim 11, wherein coordinating the first instance of the electronic game with the second instance of the electronic game comprises presenting a visual effect on the first display device and the second display device.

15. A method for providing an electronic game through a display device disposed within and forming a surface of a furnishing, the method comprising:

receiving, by a processor of the furnishing, an electrical signal from a first sensor of a plurality of sensors, each sensor of the plurality of sensors disposed at a different location on the furnishing, the electrical signal indicating a presence of a first player within a predetermined distance of the display device and a location of the first player relative to the display device;

detecting, by the processor of the furnishing, the presence of the first player within the predetermined distance of the display device and the location of the first player relative to the display device based on the received electrical signal;

presenting, by the processor of the furnishing, a first instance of the electronic game on the display device, wherein an orientation of the first instance of the electronic game as presented on the display device is dynamically adapted based on the detected presence of the first player within the predetermined distance of the display device and the location of the first player relative to the display device, and wherein the first instance of the electronic game provides interaction with the electronic game to the first player;

receiving, by the processor of the furnishing, the electrical signal from the second sensor;

detecting, by the processor of the furnishing, the presence of the second player within the predetermined distance of the display device and the location of the second player relative to the display device based on the electrical signal;

presenting, by the processor of the furnishing, a second instance of the electronic game on the display device, wherein an orientation of the second instance of the electronic game as presented on the display device is dynamically adapted based on the detected presence of the second player within the predetermined distance of the display device and the location of the second player relative to the display device, and wherein the second instance of the electronic game provides interaction with the electronic game to the second player; and coordinating, by the processor of the furnishing, the first instance of the electronic game with the second instance of the electronic game based on interaction with the electronic game by the first player or the second player.

16. The method of claim 15, further comprising receiving, by the processor of the furnishing through a wireless communications interface of the furnishing, information indicating an account of the first player used to fund game play credit for the electronic game, the information received from a mobile device of the first player.

17. The method of claim 15, further comprising:

determining, by the processor of the furnishing, that the first player is moving away from the display device based on the electrical signal from the first sensor;

in response to determining that the first player is moving away from the display device, pausing, by the processor of the furnishing, the first instance of the electronic game for up to a predetermined amount of time;

determining, by the processor of the furnishing, whether the first player has returned to the display device based on the electrical signal from the first sensor;

in response to determining the first player has returned to the display device before expiration of the predetermined amount of time, resuming, by the processor of a table, the first instance of the electronic game; and in response to determining the first player has not returned to the display device before expiration of the predetermined amount of time, ending, by the processor of the furnishing, the first instance of the electronic game.

18. The method of claim 17, further comprising:

in response to determining that the first player is moving away from the display device and before pausing the first instance of the electronic game, presenting, by the processor of the furnishing, a message on the display device, the message asking if the first player will return;

receiving, by the processor of the furnishing, an answer to the presented message;

in response to the received answer indicating the first player will not return, ending, by the processor of the furnishing, the first instance of the electronic game before expiration of the predetermined amount of time.

19. The method of claim 15, further comprising:

determining, by the processor of the furnishing, that the first player is not paying attention to the first instance of the electronic game based on interaction of the first player with the first instance of the electronic game; and in response to determining the first player is not paying attention to the first instance of the electronic game, altering game play of the first instance of the electronic game.

20. The method of claim 15, wherein the furnishing comprises a first table of a plurality of tables, wherein each table of the plurality of tables comprises a communications interface, and wherein the method further comprises:

detecting, by the processor of the first table, a second table of the plurality of tables, the second table presenting on a display device disposed within and forming a surface of the second table a third instance of the electronic game to a third player of the electronic game;

communicatively connecting, by the processor of the first table, the first table with the second table through the communications interface of the first table; and coordinating, by the processor of the first table, the first instance of the electronic game, the second instance of the electronic game, and the third instance of the electronic game based on interaction with the electronic game by the first player, second player, or third player.

* * * * *